United States Patent [19]

Swiech, Jr. et al.

[11] Patent Number: 4,642,959

[45] Date of Patent: Feb. 17, 1987

[54] VENDING MACHINE PANELS

[76] Inventors: Tom E. Swiech, Jr., 13344 Stephen Dr., Palos Park, Ill. 60464; David P. Maher, 8941 Biloba, Orland Park, Ill. 60462

[21] Appl. No.: 556,147

[22] Filed: Nov. 29, 1983

[51] Int. Cl.[4] ..... B24B 1/00

[52] U.S. Cl. ..... 52/311; 52/630; 428/192; 428/204; 428/209; 428/215; 428/457; 428/458

[58] Field of Search ..... 52/630, 311; 428/204, 428/205, 207, 209, 458, 457, 215, 192; 427/287

[56] References Cited

U.S. PATENT DOCUMENTS 4,028,165 6/1977 Rosenfeld ..... 428/204

4,327,136 4/1982 Thompson et al. ..... 428/204

4,400,419 8/1983 Laczynski ..... 428/209

4,454,179 6/1984 Bennett et al. ..... 428/207

*Primary Examiner*—James J. Bell

*Attorney, Agent, or Firm*—Fitch, Even, Tabin & Flannery

[57] ABSTRACT

An attractive, durable, three-dimensional replacement panel for a soft-drink vending machine or the like. A steel panel is laminated with a polymeric seal layer, printed with a polymeric ink to create a graphic and then overcoated with permanently bonded hard, tough crosslinked polyester material, followed by the application of a temporarily protective polymeric sheet that is applied using a release adhesive.

19 Claims, 7 Drawing Figures

VENDING MACHINE PANELS

This invention relates to outdoor display items, such as metal panels for vending machines, and to methods for making such panels. More particularly, the invention provides attractive, durable replacement panels for vending machines of the type for marketing soft drinks and the like and methods for economically making such replacement panels.

BACKGROUND OF THE INVENTION

Coin-operated vending machines for vending soft drinks or the like, particularly those which dispense single cans or bottles, are often located in an outdoor environment where they are subject not only to temperature extremes, but also to rain, snow and dirt abrasion as a result of high winds. In addition, because such machines are generally unattended, they are often subject to customer abuse, and/or vandalism. As a result, the attractive appearance of such machines can deteriorate in a relatively short period of time, and oftentimes the deterioration of the appearance results in a drop in sales because fewer customers are attracted to the machine.

Quite often such machines are owned by an independent company who leases space on the premises so that the proprietor of the premises is not directly responsible for the upkeep of the vending machine. Heretofore, it has been necessary for the owner to remove the machine from the premises to his own place of operation for refurbishing, necessitating both transportation costs and loss of sales unless a substitute machine can be provided. At his place of operation, the owner then is required to disassemble the exterior of the machine and replace the damaged or deteriorated components—an operation requiring a number of hours. Improvements in this method of operation have long been sought after.

SUMMARY OF THE INVENTION

The invention provides attractive, durable replacement panels which can be transported to the site of the vending machine and installed by a single workman in a matter of minutes, thus allowing an entire vending machine to be attractively exteriorly refurbished in a matter of less than one hour. The replacement panel is provided by coating flat metal sheet material with a polymeric seal layer of a polyester thermosetting resin and employing elevated temperature so as to create an extremely strong and essentially permanent bond to the underlying metal. By appropriately selecting a combination of polyester thermosetting material and polymeric ink material which chemically link to each other, colored graphics are silk-screened directly atop the seal layer, and heat treatment is carried out so as to create a permanent bond between the polymeric ink material and the seal layer. The seal layer preferably includes a bright, white pigment to provide a background which highlights the color of the graphics. Thereafter, a clear low-density polyethylene film is laminated atop the graphic-bearing seal layer using an acrylic adhesive which is formulated so as to permanently bond to the polymeric ink material and the seal layer and to also create an essentially permanent bond to the thin polyethylene film so that it can no longer be separated. Next, a tough, clear polypropylene sheet is laminated atop the finished planar panel to provide protection during shipping of the panels to the ultimate place of installation.

The panel is finally formed into three-dimensional form with its marginal edges bent at an angle of between about 120° and about 135° to the main panel so it can be readily attached to a dispensing machine or the like.

DETAILED DESCRIPTION OF THE PREFERRED EMBODIMENT

Figure 1:
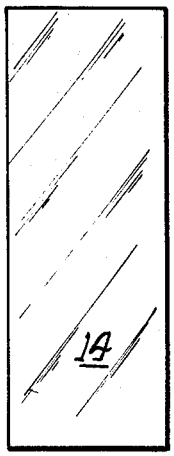
FIG. 1 is a plan view of a sheet metal panel prior to application of the graphics.
Figure 2:
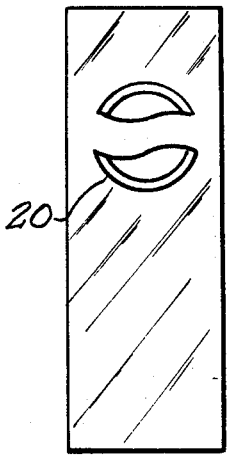
FIG. 2 is a front view of the panel of FIG. 1 after the graphics have been applied and the clear protective sheeting laminated thereupon.
Figure 3:
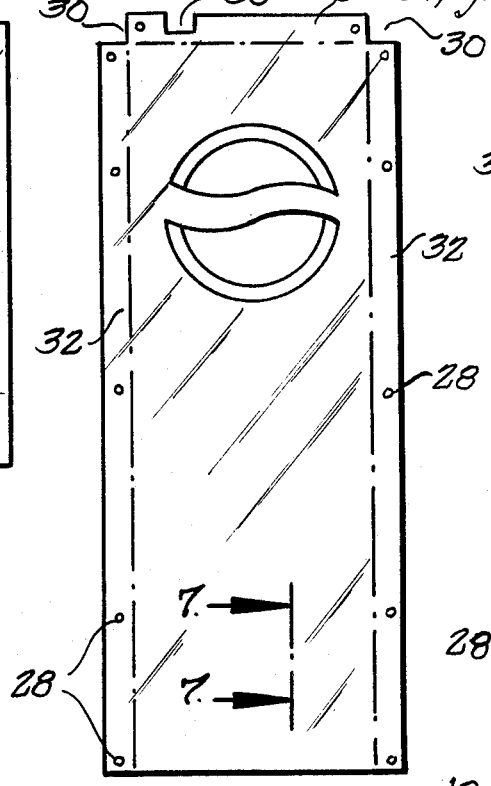
FIG. 3 is a front view of the panel following die-cutting along its upper edge.
Figure 4:
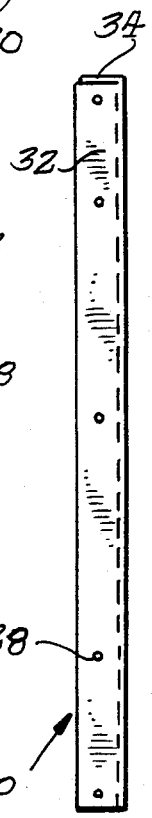
FIG. 4 is a side view of the panel following bending.
Figure 5:
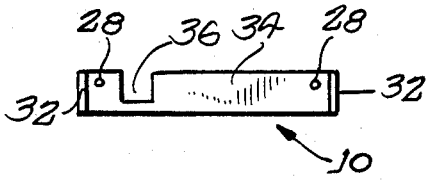
FIG. 5 is a top view of the panel following bending.

The invention provides a method for making attractive, durable replacement panels 10 for vending machines, such as coin-operated soft drink vending machines 12, which panels are simple to install and constitute a very significant improvement over the previous method of refurbishing. Heretofore, it was required that the vending machine to be removed from its operating location to the premises of the refurbisher where, the original decal was removed, the surface cleaned and prepared and a replacement decal very carefully aligned and applied. The replacement panel provided by the invention is fabricated from suitable metal sheet material, such as 20-gauge or 24-gauge cold-rolled steel. Generally, any suitable metal alloy having reasonable structural strength and resistance to denting may be used in a thickness of between about 20 mils and 40 mils. Steel is preferred because of its relatively low cost and excellent structural properties, and the steel sheet is endowed with adequate longevity in an outdoor environment as a result of the rust-resistant coating which is applied thereto.

The first step in the fabrication process involves the application of a polymeric seal coating to both the front and the rear surfaces of a rectangular sheet steel panel 14 after these surfaces have been appropriately cleaned and degreased using a suitable cleaner as known in the art, e.g. that sold as Bonderite 901. A polyester coating material 16 is carefully chosen which has excellent hardness, mar-resistance and the ability to tolerate a subsequent bending operation which is employed to create the three-dimensional replacement panel. Because it is the intention that the replacement panel carry a permanent and attractive graphic to promote the sale of the product being vended, e.g., soft drinks, further considerations in the choice of the polymeric material for the seal layer are its compatibility with ink materials to be used to create the graphic and its ability to form a permanent chemical bond with a polymeric ink material.

Preferably, a polyester thermosetting resin material is used which is applied in a suitable solvent system, such as a 50–50 mixture of Butyl Cellosolve and Solovesso 150. Heat is required to activate the thermosetting resin, and it is preferably applied as a hot-melt, in which form it can be easily coated to a desired thickness on the cold-rolled steel sheet. It will normally be applied, by roll-coating, as a wet film about $1\frac{3}{4}$ mils thick so as to, when dry, provide a thickness of about 1 mil, as it has been found that the final dried thickness of the seal layer should be between about 0.5 mil and 1.5 mil in order to provide the rust-resistant protection for and the permanency of attachment to the underlying steel sheet. Although the hot-melt coating can be applied in any suitable manner, it has been found that roll-coating is economical and acceptable.

Immediately following roll-coating, the sheet is heated to a temperature of about 400° C. in a circulating air oven or the like which is maintained at a higher temperature, e.g. 560° F. Sufficient heating is usually effected in a period of five minutes or less, e.g. about 2 minutes, which substantially completely removes the solvents and effects the thermosetting of the polyester material, producing the desired hardness and a strong bond to the underlying steel sheet. Both front and rear surfaces of the sheet may be coated simulataneously and baked; however, it has proved easier to coat first one surface and carry out the baking step to harden it before coating and baking the remaining surface.

To satisfy the compatibility requirements and assure that the polyester material will achieve a strong bond to the steel sheet and to the polymeric ink material, it has been found that the polyester should be an aromatic polyester, sometimes referred to as a polyarylate. It is made from a polyfunctional organic alcohol or glycol, preferably Bisphenol A, in about a 1:1 ratio with a dibasic aromatic organic acid, preferably a mixture of iso- and terephthalic acids. Suitable polyester coatings are available under the tradename CML and from PFM, Inc. of Elk Grove Village, Illinois.

The polymeric material formulation preferably includes a bright, white, light-reflecting pigment, such as that employed on fluoroescent light fixtures. It is found that the presence of the pigment not only adds to the brightness and attractiveness of the overall graphic, but it has a significant effect on resistance to ultraviolet degradation which is a significant consideration in any application directed to outdoor use.

The ink material 18 used to create the multi-colored graphic 20 is designed to provide durability and long life by chemically bonding to the surface of the polyester seal layer. A base for the colored pigment, which base may constitute about 55 percent of the mixture, preferably between about 50 and 80 weight percent, is formed from relatively low molecular weight oligomers of vinyl chloride and methacrylate, preferably methyl methacrylate, and/or methyl or ethylacrylate. This particular copolymeric base is compatible with a number of suitable pigments and forms a strong, covalent bond to the underlying polyester seal layer to achieve true permanency of the imprinted graphic 20. Suitable materials are available under the tradename Kolorcure from T & C Apex printing inks. Such polymeric ink materials are preferably formulated with a sufficient amount of a solvent, such as cyclohexane, to form a paste-like material of appropriate viscosity to allow application by silk-screening, which is the preferred method of creating the graphic. However, other suitable printing methods may also be used.

The ultimate "no-mar" finish to the panel is provided by a polyethylene terephthalate overcoat 22 which is optically clear so as to in no way detract from the colorful graphic that has been printed upon the bright, white, generally reflective background. The polyethylene terephthalate overcoat should have a thickness between about 0.75 and 2 mils and is preferably about 1 mil thick in the hardened state. It bonds permanently to the underlying graphic-bearing seal layer 16 and to the ink material.

It has been found that the particular combination of polymeric ink material and thermoset polyester seal layer will strongly bond to the overcoat layer 22 when an appropriate polyester base material is used, preferably a suitable aromatic polyester resin combined either with a polyurethane resin as a part of a hot-melt formulation, or with a self cross-linkable acrylic resin and dissolved in a suitable solvent. Using either of these two materials which contains a polyethylene glycol-terephthalic acid base material, an overcoating is applied using standard laminating techniques followed by a subsequent heating step. The thickness of the overcoating applied is such that, upon hardening, the overcoat has a thickness of at least about 0.75 mil and preferably of about 1 mil. In the subsequent heating, the temperature is raised to between about 280° and about 290° F. so as to effect the ultimate bonding and hardening of the polyester overcoat and create an integral, attractive, durable, "no-mar" finish upon the panel.

To protect the panel during the subsequent forming operations and throughout shipping and installation, a protective sheet 26 of tough, clear polypropylene or (LDPE film is laminated atop the thermoset polyester material 22. The width of the protective sheet 26 is preferably coextensive with the width of the panel 14, although it could be slightly narrower so as to leave the lateral edges uncovered, for a reason to be explained hereinafter with respect of installation. The thickness of the protective sheet 26 should be sufficient to provide the desired protection during handling, and in this respect, a sheet between about 2 and 8 mils thick should be used. For example, a 2 mil thick sheet of LDPE or polypropylene can be laminated using a standard release-type adhesive 24 which allows the protective sheet 26 to be removed following installation, leaving substantially no noticeable residue upon the underlying polyester layer 22 which constitutes the exterior surface of the installed replacement panel 10.

Following the lamination of the protective, clear sheet 26, the planar laminated panel is punched and die-cut to provide a series of holes 28 along the marginal edges of the two sides and top and also to remove a pair of square cut-outs 30 at the upper corners which provide clearance for bending the marginal edges 32 and 34 into three-dimensional configuration. Depending upon the particular make of the vending machine to which the panel 12 is to be applied, one or more additional cut-outs 36, such as that shown in the upper marginal edge 34, may be die-cut to provide clearance for hinges or the like.

Either simultaneous with the die-cutting operation, or immediately thereafter, the marginal edges are bent to form about a right angle with the main panel. A pair of panels can be packaged and shipped within a corrugated box or the like for the refurbishing of a particular manufacturer's vending machine. The overall dimensions allow the installer to easily fit the panel to the machine upon location.

Figure 6:
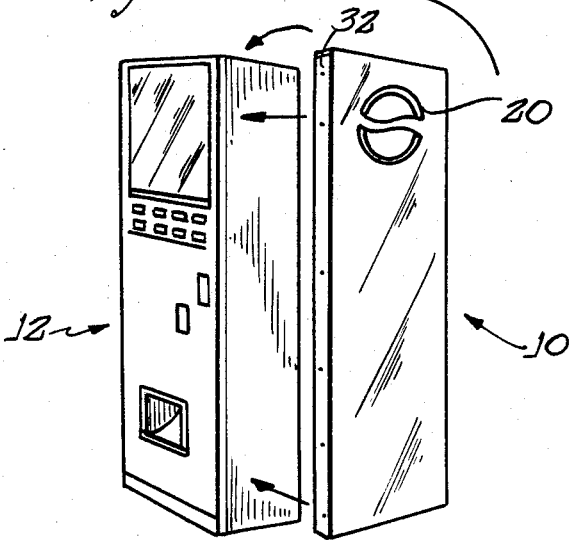
FIG. 6 is a perspective view schematically illustrating the installation of the pre-bent replacement panel onto a soft-drink vending machine.

The installation process is illustrated in FIG. 6 wherein the panel is shown as it would be oriented to the vending machine 12. Although not shown, the front door portion of the machine would be opened at this time. A bead of suitable caulking material, such as acrylic latex caulk is laid down on the rear surface of the replacement panel along the three lines or creases where the marginal edges have been bent from the body of the main panel portion. This caulking provides a water-tight seal along the interior of the panel on the refurbished machine. After each marginal edge is aligned in desired position upon the machine, holes are drilled into the casing of the vending machine using the pre-punched holes 28 as a guide, and a pop-rivet is quickly and easily inserted into the punched and drilled holes to secure the edge of the replacement panel in place. After each of the three marginal edges has been secured, the installer is then able to repeat the process on the opposite side of the vending machine. An appropriate front replacement panel may be also included, depending upon the brand of vending machine being refurbished. As should be apparent, the installation is quickly accomplished in a matter of minutes by a single installer and provides an attractive and particularly durable refurbished vending machine. After the panel installation is complete, and all marginal edges have been secured, the protective outer sheeting 26 is easily stripped from the panels, the LDPE or polypropylene having sufficient resiliency to simply stretch and slide over the heads of the pop-rivets in the region of the punched holes 28.

Figure 7:
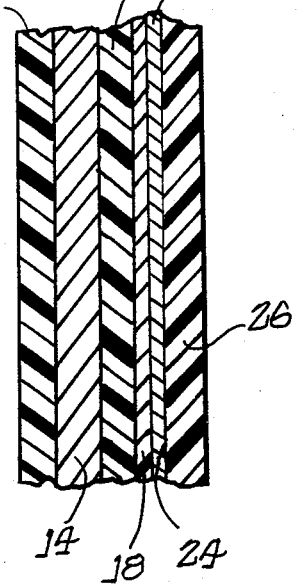
FIG. 7 is an enlarged fragmentary sectional view taken through the panel shown in FIG. 3 prior to bending.

FIG. 7 illustrates, in enlarged view, a cross sectional orientation of the various layers which together provide the particularly durable and attractive replacement panel. The structural strength and rigidity is of course provided by the steel panel 14 which is excellently protected from rust by the strongly adherent seal layers of the polyester material 16 which preferably contain the generally reflective, white pigment to provide a clean and bright, attractive background for the colored graphic. The graphic is provided by the silk-screening process which utilizes the pigmented ink material 18, that is polymeric in nature and is heat-treated in a manner so as to stablize and to chemically attach to the underlying polyester seal layer upon which it has been imprinted. Thereafter, overcoating is carried out using a specially selected polyester material 22 which is optically clear and chemically bonds to both the pigmented polymeric graphic material and the polyester seal layer surface where there is no graphic, providing the finishing-touch and resulting in a particularly attractive, hard, tough, "no-mar" surface appearance. It is the combination of this particular aromatic polyester material overcoat and its strong attachment to the underlying polymeric material which creates outstanding scratch resistance that can be of utmost importance in the soft drink vending area where vandalism may often be prevalent. In fact, the polyester overcoat surface nearly defies abrasion, nicks and scratches, and the surface is essentially integral with the supporting steel sheet and is incomparably more durable than the decals with which such vending machines have heretofore been decorated. The final protective sheeting assures protection of the partially preformed panel when it is likely most susceptible to inadvertent damage, i.e. before it has been supported in place upon the vending machine which provides back-up and overall stability. Its resiliency allows it to remain in place until the installation is completed and then stripped from the maohine over the heads of the attaching rivets or screws.

Although the invention has been described with respect to certain preferred embodiments, it should be understood that modifications such as would be obvious to one having the ordinary skill in this art may be made without departing from the scope of the invention which is defined by the claims appended hereto. Various features of the invention are emphasized in the claims which follow.

What is claimed is:

1. A decorative metal replacement panel for a dispensing machine of the like which comprises flat metal sheet material, a polymeric seal layer of polyester thermosetting material coating the entire front surface of said metal sheet material and being bonded strongly thereto, a colored graphic formed of ink material and disposed upon the front surface of said polymeric seal layer, said ink material being strongly chemically bonded directly to the front surface of said polymeric seal layer as a result of heat-curing, an optically clear hard, polyester material overcoat strongly and permanently bonded to the front surface of said graphic-bearing coated sheet material across substantially the entire surface of said polymeric seal layer thereof including the region where said ink material is disposed, and protective film material laminated to said overcoat, said coated sheet metal material and film laminate being bent from planar configuration into a three-dimensional configuration replacement panel designed for attachment to a dispensing machine or the like.

2. A panel in accordance with claim 1 wherein said sheet metal material is a sheet of steel having a thickness of between about 20 mils and about 40 mils and wherein both front and rear surfaces thereof are coated with said polymeric seal layer.

3. A panel in accordance with claim 2 wherein protective polymeric film sheeting having a thickness of at least about 2 mils is attached to the front surface of said overcoat using a release-type adhesive.

4. A panel in accordance with claim 3 wherein said clear overcoat about 1 mil thick.

5. A panel in accordance with claim 4 wherein said laminate is die-cut at its corners and the marginal edges thereof are bent at about right angles to the front surface to facilitate installation of the three-dimensional shape.

6. A panel in accordance with claim 4 wherein overcoat comprises a cross-linked polyethylene terephthalate which is bonded to said ink material and to said seal layer.

7. A panel in accordance with claim 6 wherein said ink material includes vinyl and acrylic oligomers to which said overcoat forms a permanent bond.

8. A panel in accordance with claim 1 wherein said polymeric polyester coating material contains a reflective white pigment which causes said seal layer to be opaque.

9. A decorative metal display item for outdoor use which item comprises flat metal sheet material, a polymeric seal layer of opaque, polyester thermosetting material containing a reflective white pigment, coating the entire front surface of said metal sheet material and being bonded strongly thereto, a colored graphic formed of ink material and disposed upon the front surface of said opaque seal layer, said ink material being strongly chemically bonded directly to the front surface of said polymeric seal layer as a result of heat-curing, and an optically clear, hard, tough crosslinked polyester material overcoat strongly and permanently bonded to the front surface of said graphic-bearing coated sheet material across substantially the entire surface of said polymeric seal layer thereof including the region where said ink material is disposed.

10. A display item in accordance with claim 9 wherein said sheet metal material is a sheet of steel having a thickness of between about 20 mils and about 40 mils and wherein both front and rear surfaces thereof are coated with said polymeric seal layer.

11. A display item in accordance with claim 10 wherein protective polymeric sheeting having a thickness of at least about 2 mils is attached to the front surface of said overcoat using a release-type adhesive.

12. A display item in accordance with claim 11 wherein said clear polymeric sheeting is between about 2 and 8 mils thick.

13. A display item in accordance with claim 10 wherein said ink material is covalently bonded to said opaque polyester seal layer which is an aromatic polyester.

14. A display item in accordance with claim 10 wherein said clear overcoat is about 1 mil thick.

15. An item in accordance with claim 14 wherein overcoat comprises a cross-linked polyethylene terephthalate which is strongly bonded to said ink material and to said seal layer.

16. An item in accordance with claim 15 wherein said ink material includes vinyl and acrylic oligomers to which said overcoat forms a stong permanent bond.

17. A decorative metal replacement panel for a dispensing machine or the like which comprises flat metal sheet material at least about 20 mils thick and die cut to a shape to cover one surface of a dispensing machine, a polymeric seal layer of opaque, polyester thermosetting material containing a reflective white pigment coating the entire front and rear surfaces of said metal sheet material and being strongly adherent thereto, a colored graphic formed of ink material and disposed upon the front surface of said polymeric seal layer, said ink material being strongly chemically bonded directly to the front surface of said polymeric seal layer as a result of heat-curing, an optically clear, hard, tough, aromatic polyester material overcoat at least 0.5 mil thick strongly and permanently bonded to said opaque, polyester material on the entire front surface of said graphic-bearing coated sheet material and the region where said ink material is disposed, and protective film material laminated to said overcoat with release-type adhesive, said coated sheet metal material and film laminate being bent from planar configuration into a three-dimensional configuration replacement panel designed for attachment to a dispensing machine or the like.

18. A panel in accordance with claim 17 wherein said ink material includes at least 50% weight percent of an acrylic base material.

19. A panel in accordance with claim 17 wherein said ink material includes about 55% of a mixture of vinyl and acrylic oligomers.

* * * * *